US008172475B2

(12) United States Patent
Rosenzweig et al.

(10) Patent No.: US 8,172,475 B2
(45) Date of Patent: May 8, 2012

(54) LIQUID DROPLET EJECTING HEAD, A WRITING INSTRUMENT COMPRISING SUCH A HEAD, AND A METHOD OF EJECTING LIQUID DROPLET FROM SAME

(75) Inventors: Alain Rosenzweig, Saint Maur des Fosses (FR); Kurt Rath, Herblay (FR); Colin Philip Brooks, Wokingham (GB); Andy Hills, Shepperton (GB)

(73) Assignee: Societe Bic, Clichy Cedex (FR)

( * ) Notice: Subject to any disclaimer, the term of this patent is extended or adjusted under 35 U.S.C. 154(b) by 1129 days.

(21) Appl. No.: 11/997,839

(22) PCT Filed: Aug. 3, 2005

(86) PCT No.: PCT/EP2005/009224

§ 371 (c)(1),
(2), (4) Date: Feb. 4, 2008

(87) PCT Pub. No.: WO2007/014578

PCT Pub. Date: Feb. 8, 2007

(65) Prior Publication Data

US 2008/0170105 A1 Jul. 17, 2008

(51) Int. Cl.
*B41J 3/36* (2006.01)

(52) U.S. Cl. ..... 401/195; 347/109

(58) Field of Classification Search ..... 401/195; 346/140.1; 364/479.05; 347/109
See application file for complete search history.

(56) References Cited

U.S. PATENT DOCUMENTS

| | | | | |
|---|---|---|---|---|
| 6,454,482 | B1 * | 9/2002 | Silverbrook et al. | 401/195 |
| 2002/0136587 | A1 | 9/2002 | Bramlett et al. | |
| 2004/0052569 | A1 | 3/2004 | Bich et al. | |
| 2005/0206690 | A1 | 9/2005 | Bich et al. | |

FOREIGN PATENT DOCUMENTS

| | | |
|---|---|---|
| JP | 11-129464 | 5/1999 |
| WO | WO 02/34549 | 5/2002 |
| WO | WO 2005/061245 | 7/2005 |

* cited by examiner

*Primary Examiner* — David J. Walczak
(74) *Attorney, Agent, or Firm* — Jones Day

(57) ABSTRACT

A liquid droplet ejecting device suitable for ejecting a droplet from a substrate onto a support at a distance greater than usual. A liquid droplet ejecting head that includes a plurality of actuating chambers is linked to a single common ejection nozzle through which a droplet is to be ejected from the head.

20 Claims, 7 Drawing Sheets

LIQUID DROPLET EJECTING HEAD, A WRITING INSTRUMENT COMPRISING SUCH A HEAD, AND A METHOD OF EJECTING LIQUID DROPLET FROM SAME

CROSS-REFERENCE TO RELATED APPLICATIONS

This application is a national stage application of International Application No. PCT/EP2005/009224, filed on Aug. 3, 2005, the entire contents of which are incorporated herein by reference.

BACKGROUND OF THE INVENTION

1. Field of Invention

The embodiments of the present invention relate to liquid droplet ejecting heads, and to liquid droplet ejecting instruments comprising such heads. The embodiments of the present invention also relate to a method of ejecting liquid droplets from such liquid droplet ejecting heads.

2. Description of the Related Art

More particularly, embodiments of the present invention relate to a liquid droplet ejecting head designed to be mounted in a liquid ejecting instrument, comprising a plurality of actuating chambers, each actuating chamber having at least one inlet to be connected to at least one liquid supply chamber for providing liquid to the actuating chamber, at least one actuating means suitable for creating a pulse wave in the liquid contained therein when activated by energy received from a control device, and at least one outlet connected to an ejection nozzle.

Prior art is known describing ink ejecting heads containing a plurality of actuating chambers. However, they have one nozzle of ejection for each ink-ejecting actuator, and a plurality of droplets originating from a plurality of nozzles are ejected. These ejecting heads are generally used in a protected environment where drafts of air are minimal, ejecting distances are known and generally stay constant, for example in desk printers. In cases where it has been provided for variable scan speed prior art have generally relied on varying the frequency of ejection to achieve more ink deposition. However this does not resolve the problem that they still face of ejecting over greater distances.

SUMMARY OF THE INVENTION

Embodiments of the present invention has been conceived in consideration of the above mentioned problems, and an object of the invention is to provide a liquid droplet ejecting device suitable notably for ejecting a droplet from a substrate onto a support at a distance greater than usual. To this end an aspect of the invention is to provide a liquid droplet ejecting head of the above mentioned type characterized in that the outlets of the plurality of actuating chambers are linked to a single common ejection nozzle through which a droplet is to be ejected from the head.

Bigger, and therefore heavier, droplets will be ejected, and they will travel further and truer than smaller droplets. This is an important advantage when using hand-held writing instruments where distances between the liquid droplet ejecting head and the writing surface are generally far larger than applications where traditional ink ejection technology is used, such as inkjet printers. It should also be noted that this invention allows for the use of typically-sized actuators, such as those used in desktop inkjet printers, to create bigger-than-typical sized drops by combining many small droplets into bigger ejected droplets. Because of the smaller actuator size, this allows for greater positioning and arranging freedom of the actuators within a liquid droplet ejecting head.

A supplementary advantage is the possibility to vary the volume of the ejected droplets as a function of user-input or deduced outcome by having the option of actuating a different number of actuators at each ink firing, and have a single drop of varying size exit through a single nozzle towards a support. This is especially useful to mark lines of varying thickness without having to vary frequency.

Various embodiments of the invention may additionally include any one of the following provisions the outlets of the actuating chambers are connected to a common central exit chamber, the exit chamber being in connection with the ejection nozzle;

the central exit chamber contains a deflection member in the center to deflect liquid flow pulses towards the ejection nozzle;

the plurality of actuating chambers are arranged around the common ejection nozzle in a radial pattern;

the actuating chambers are arranged in a symmetrical pattern and in an even number;

the plurality of actuating chambers represent an odd number, preferably three actuating chambers extending respectively toward the 3 edges of a triangular shaped flat body;

a plurality of liquid feed chambers are provided, each communicating with at least one actuating chamber and having or sharing a through hole to be in fluidic connection with a liquid reservoir;

the liquid droplet ejecting head is substantially flat shaped with a front face and a rear face, parallel to each other, the nozzle being formed in the front face, and holes in communication with the inlets of the actuating chambers being provided on the rear face;

the inlets and outlets of the plurality of actuating chambers extend globally in the main plane of the flat body, and preferentially along a radial direction from the ejection nozzle direction;

the liquid ejecting head is manufactured out of a silicon wafer, or other suitable material;

the actuating means comprises one of the following means chosen in the group including: electrostatic, thermal, piezoelectric actuating means, and preferably an electrostatic means;

An ejecting head as defined above is particularly suitable to be used in a hand held liquid ejecting instrument having a substantially tubular body with an opening at a front end and containing a liquid reservoir, an energy storage means, a control unit and a liquid droplet ejecting head according to any one of the previous provisions, and wherein the ejection nozzle of the ejection head faces the front opening of the tubular body.

The embodiments of the present invention concerns also a droplets ejecting method for controlling the ejection of droplets by the liquid ejecting head mounted in a liquid ejecting instrument characterized in that it comprises the following steps providing a plurality of actuating chambers, each actuating chamber having at least one inlet, at least one actuating means suitable for creating a pulse wave in the liquid contained therein, and at least one outlet;

providing a common ejection nozzle in a fluidic connection with the outlets of the plurality of actuating chambers, feeding the actuating chambers through their inlet with liquid provided from a liquid reservoir;

actuating at least one of the actuating means by a supply of energy from a control unit in a manner such that one liquid droplet is ejected through the common ejection nozzle.

In another preferred embodiment, the invention may also additionally include any one of the following steps the actuating step comprises the simultaneous actuation of at least two actuators;

the actuating step comprises the actuation of an even number of actuating means, and wherein the actuators are arranged in opposite symmetrical pairs;

the actuating step comprises the actuation of an odd number of actuating means, preferably 3 or 5, and wherein the actuators are arranged equidistant and in equiangular position with respect to the common ejection nozzle;

the method further comprises a step of determining a number of actuating means to be actuated to obtain a determined droplet size, before the actuating step;

the instrument is a hand held instrument, comprising position and/or movement sensing means, wherein the liquid is an ink, and wherein the method further comprises the steps of:

determining a writing condition from the signals sensed by sensing means;

ejecting ink droplets repeatedly while a writing condition is determined, and preferably at constant ejection frequency.

the steps of evaluating the droplet size according to a least one of the parameters of the group including a sensed scan speed of the writing instrument, a sensed distance between a writing surface and the ejection nozzle, and desired thickness or style of the line to be drawn.

BRIEF DESCRIPTION OF THE DRAWINGS

Other characteristics and advantages will appear to those skilled in the art in the following detailed descriptions, in which:

On each of the figures, the same reference numerals refer to identical or similar elements.

FIG. 1 represents a particular embodiment of a liquid droplet ejecting head 100 mounted in a non-contact writing instruments 1. However, the embodiments of the present invention also lends itself to being used in handheld or desktop printers, or other similar devices.

Figure 1:
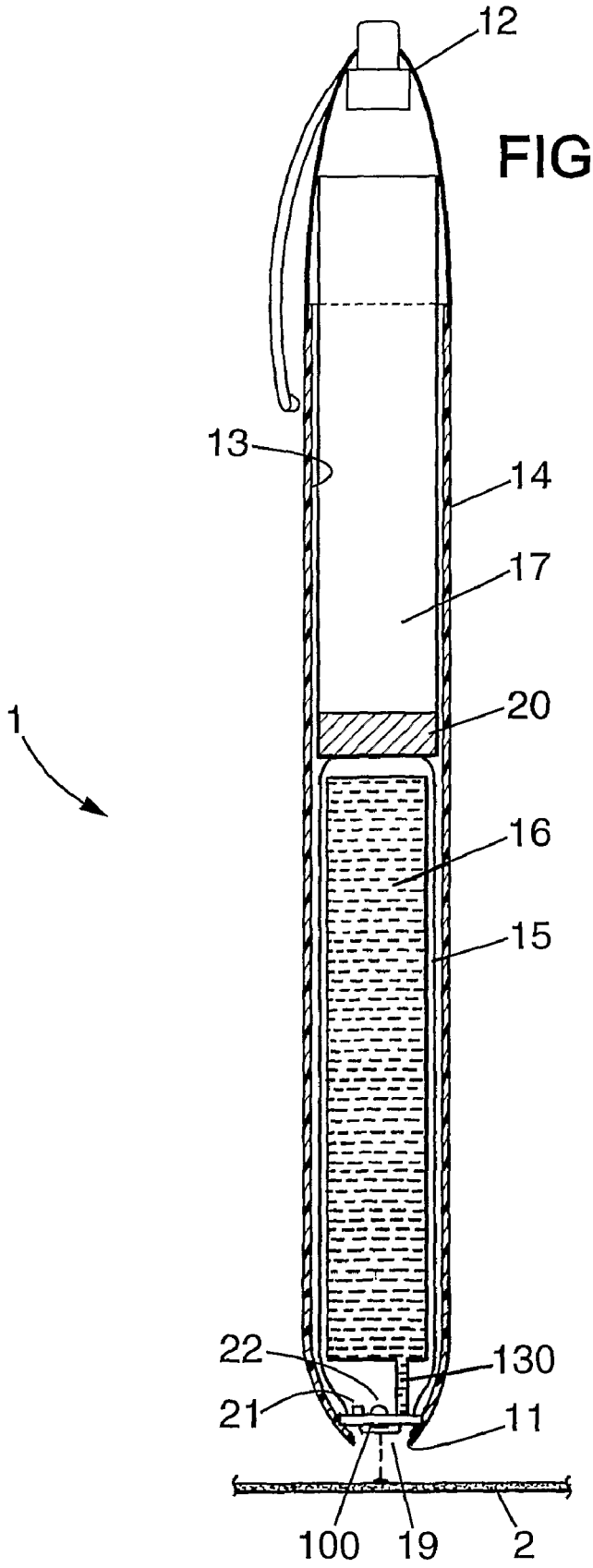
FIG. 1 is a sectional representation of a writing instrument comprising an ejection head according to a first embodiment.

The writing instrument has a substantially tubular element that extends between a front end 11 and a rear end 12 for forming a pen. The tubular element has an inside wall 13 defining a hollow internal space, and an outside wall 14 designed to be held in the hand of a user.

The interior hollow section of the writing instrument comprises a liquid reservoir 15 mounted in a removable fashion such that it may be easily end-user replaceable and contains liquids 16. It is to be noted that the liquid used in this particular embodiment presented, that of the writing instrument, will have visible ink as its liquid. However, depending on the application, the liquid may also be correcting fluid, glue or others to suit the application.

The writing instrument 1 further comprises an energy-storage unit 17 to provide energy to a control unit 20 and a liquid ejecting device 100. The energy storage 17 may be mounted from the writing instrument 1 such that it may be easily replaceable, or it may be integrated with the liquid reservoir 15 as described in the French patent application filed on Jul. 22, 2004 under the application number FR0408138, or have means on the writing instrument for recharging.

The writing instrument may also comprise other devices such as a means of measuring distance between the liquid ejecting head 100 and the writing medium 2, such as with an optical range finder 21, and means of measuring writing activity of the pen, for example with an accelerometer 22.

The writing instrument 1 further comprises the liquid droplet ejecting head 100 according to a first embodiment, which faces a front opening 19 situated at the front end 11 of the writing instrument 1. The head is physically small such that it can be located near to the front end 11 forming the pen tip without causing visual obstruction to the user.

It would be apparent to those skilled in the art that this is just one possible application and that this invention has equally valid uses in handheld printers, desktop printers, or other instruments which releases liquids onto a support without physical contact between the instrument and the support.

At least one fluidic link 130 exists between the liquid reservoir 15 and the liquid droplet ejection head 100.

The control unit 20, which comprises a central processing unit, system clock, and other parts, serves to process all data such as those of distance and writing activity measurements, and also to regulate and energize the energy pulses provided for the actuation of the droplet ejecting head 100 responsible for ejecting liquid 16 out of the nozzle 99.

The control unit 20, which comprises a central processing unit, system clock, and other parts, serves to process all data such as those of distance and writing activity measurements, and also to regulate and energize the energy pulses provided for the actuation of the droplet ejecting head 100 responsible for ejecting liquid 16 out of the ejection nozzle 99.

Figure 2A:
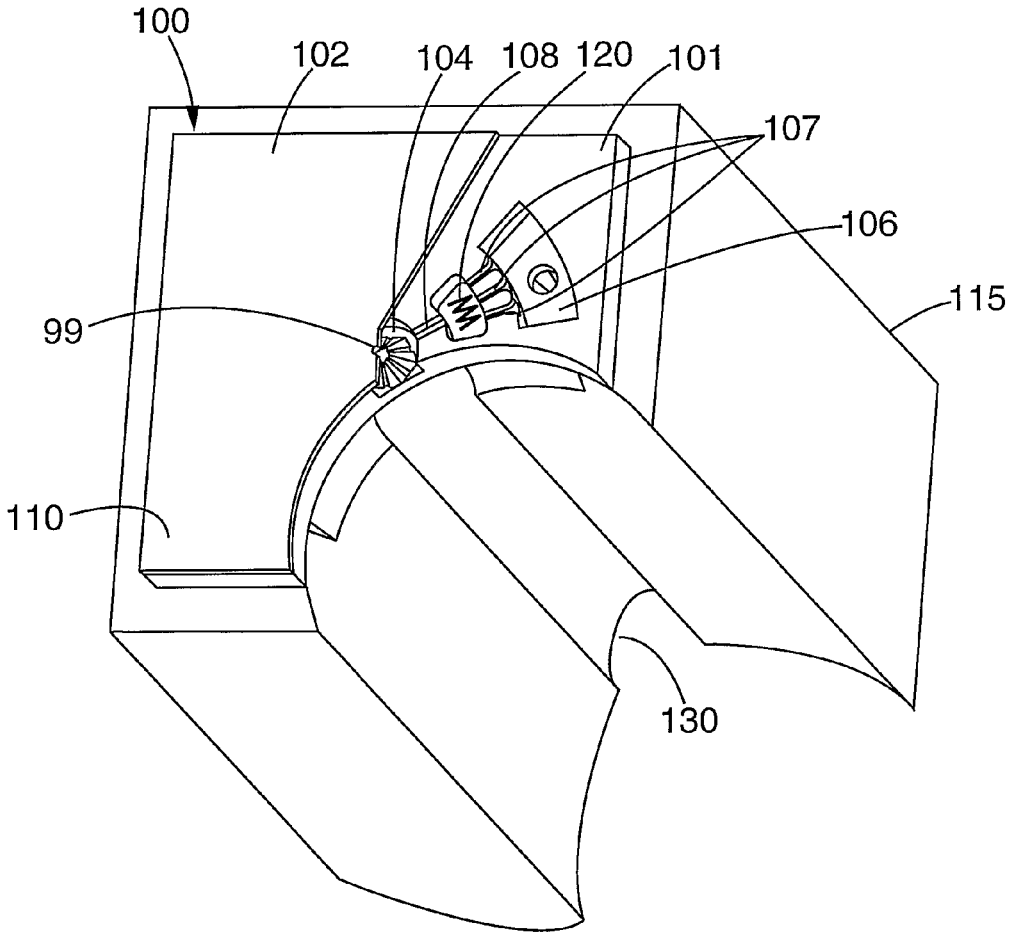
FIG. 2*a* shows perspective cut-away view of the first embodiment of the ejection head comprising a cover plate and a base plate, positioned on a mounting block.

As best shown on FIG. 2*a*, the end portion of a mounting block 115 serving as both a support for the ejection head 100 and as a channel 130 for the feeding of liquid incoming from the liquid reservoir 15.

The liquid droplet ejecting head 100 is defined by a base plate 101 on which multiple actuating means 120, also called actuators, for ejecting liquid 16 are provided and a cover plate 102 placed onto the base plate 101 to cover the base plate and thus contain the liquid 16 in the chambers contained therein. The base plate 101 contains multiple channels 107,108 etched in it.

A plurality of actuating chambers 105 and feeding chambers 106 are provided, although only one is visible on FIG. 2*a*. As best shown on FIG. 5, three channels 107 establish a fluidic communication between the feeding chamber 106 and the actuating chambers 105, and form the inlets of the actuating chamber 105. The channel 108 establishes a fluidic communication between the actuating chamber 105 and the common ejection chamber 104, and form the outlet of the actuating chamber 105. However, a different number of channels are possible.

The actuating chamber 105 comprising an actuation means 120 is linked to a control unit 20 by signal lines 121 for driving the actuation means 120. The cover plate 102 has a single nozzle 99 formed therein positioned in the center of the plate 102, aligned with the center of the central ejection chamber 104 of the base plate 101. The outer face 10 of the cover plate 102 forms a front face of the ejecting head 100 in which emerges the nozzle 99.

Figure 2B:
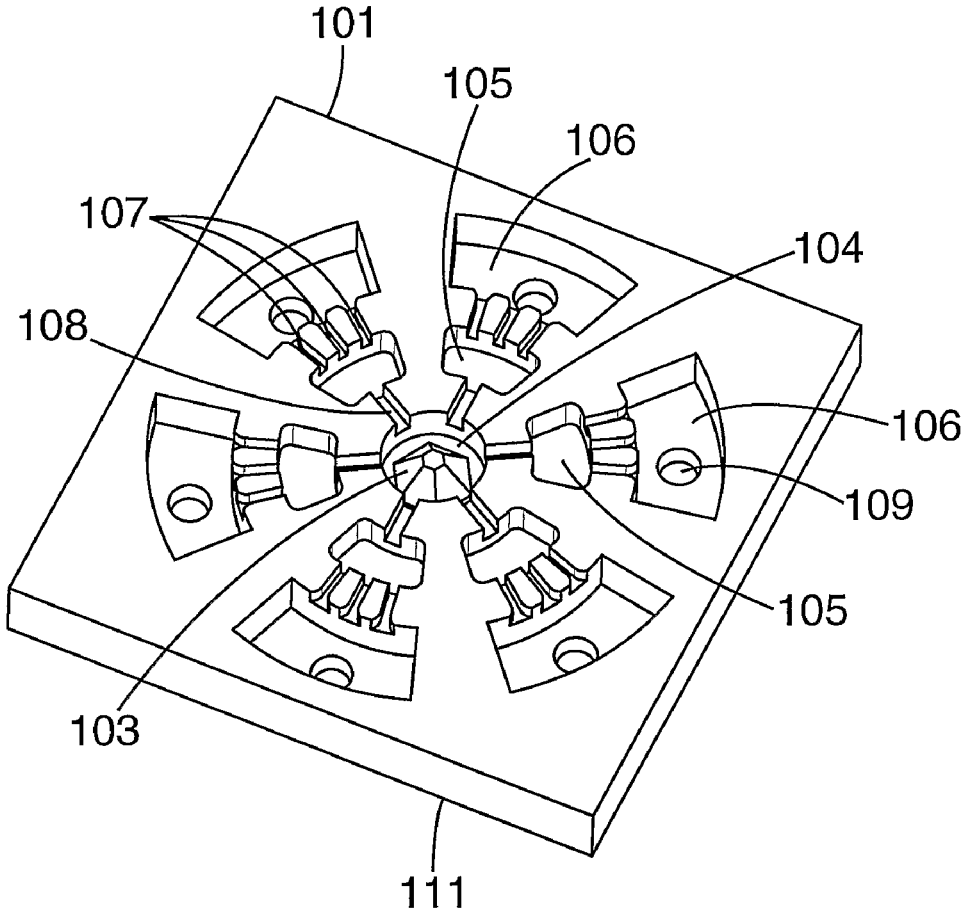
FIG. 2*b* shows the base plate of the head represented in FIG. 2*a*.

As can be seen on FIG. 2*b*, the six actuating chambers 105 and liquid feed chambers 106 are arranged around the common ejection chamber 104 in a radial pattern. Each path formed by the channels 107,108 of one actuating chamber 105 and one feeding chamber 106 radiates from the common ejection chamber 104 and is separated from adjacent paths 107,108 by separating walls formed integrally in the base plate 101. Equidistant from the center, equiangular from each other, and lying on the same paths are the actuating chambers 105 and the feeding chamber 106 at the periphery. All chambers 104,105,106 extend globally in the main plane of the base plate 101 constituted by a flat body. Liquid 16 flows into the central ejection chamber 104 from pulses by the actuators 120 which are part of the actuating chamber 105. The actuating chambers 105 themselves are supplied with liquid 16 from liquid feed chambers 106, such that each actuating chamber 105 is singularly connected with one liquid feed chamber 106. However in other embodiments, it may be realizable to have one liquid feed chamber 106 connected to more than one actuating chamber 105.

An ink supply hole 109 located in each liquid feed chamber 106 is perforated through the thickness of the base plate 101 and emerges in the rear face 111 of the base plate 101 which constitutes the rear face of the ejecting head. The holes 109 communicate with the liquid reservoir 15. The base plate 101 and the cover plate 102 are of a substantially flat rectangular shape, and are manufactured by a semiconductor process using a silicon wafer.

The liquid feed chamber 106 is in fluidic communication with the liquid reservoir 15 and temporarily stores a small amount of liquid 16 that is allowed to flow from the feed chamber 106 into the actuating chamber 105.

Furthermore, the fluidic connection from the liquid feed chambers 106 connecting the actuating chambers 105 is designed in such a way for easing the flow of liquid 16 into the actuating chamber 105 but providing much greater resistance to backward flow under a pulsed pressure effected by the actuators 120. The channel 108 between the actuating chamber 105 and the central exit chamber 104 should provide as little resistance as possible to the pulsed liquid traversing this channel towards the nozzle 99.

Located centrally in the central exit chamber is positioned a deflection member 103 to guide the liquid droplet pulses out of the singular nozzle 99.

Figure 6:
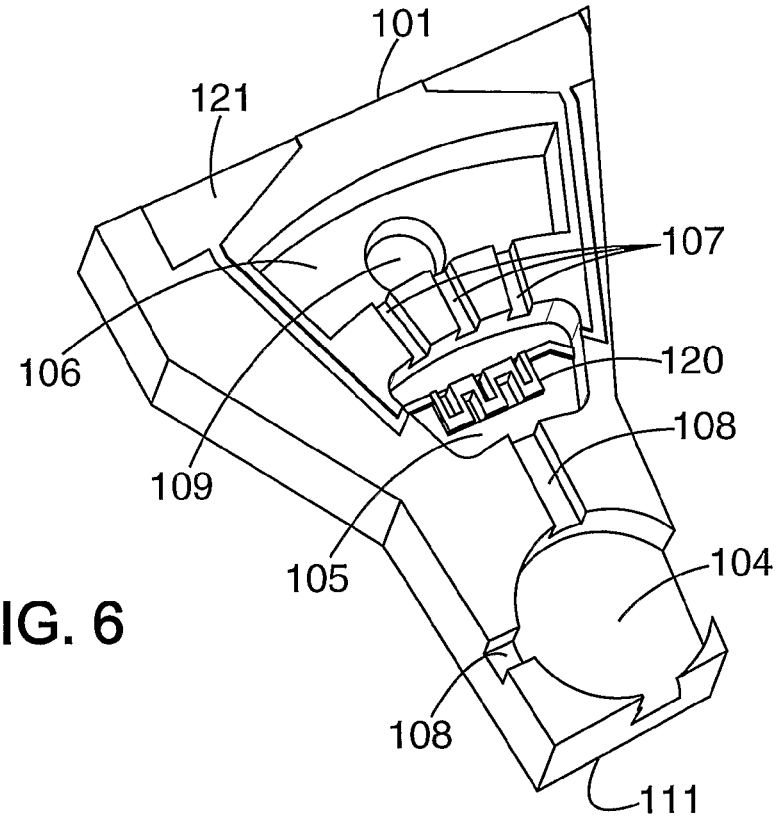
FIG. 6 is perspective view of a portion of a base plate of an ejecting head, showing just a single ejection chamber.

Each module section, as shown in FIG. 6, is positioned in a radial direction around the central exit chamber 104, the module including a feed chamber 106 and an actuation chamber 105 with channels 107 therebetween, and channel 108 leading out of the actuating chamber 105. Each module is sensibly sector-shaped.

However, they may be formed of any shape, but preferably the distances between the actuators 120 and the central chamber 104 remain substantially equal and/or in a radial pattern.

Figure 3:
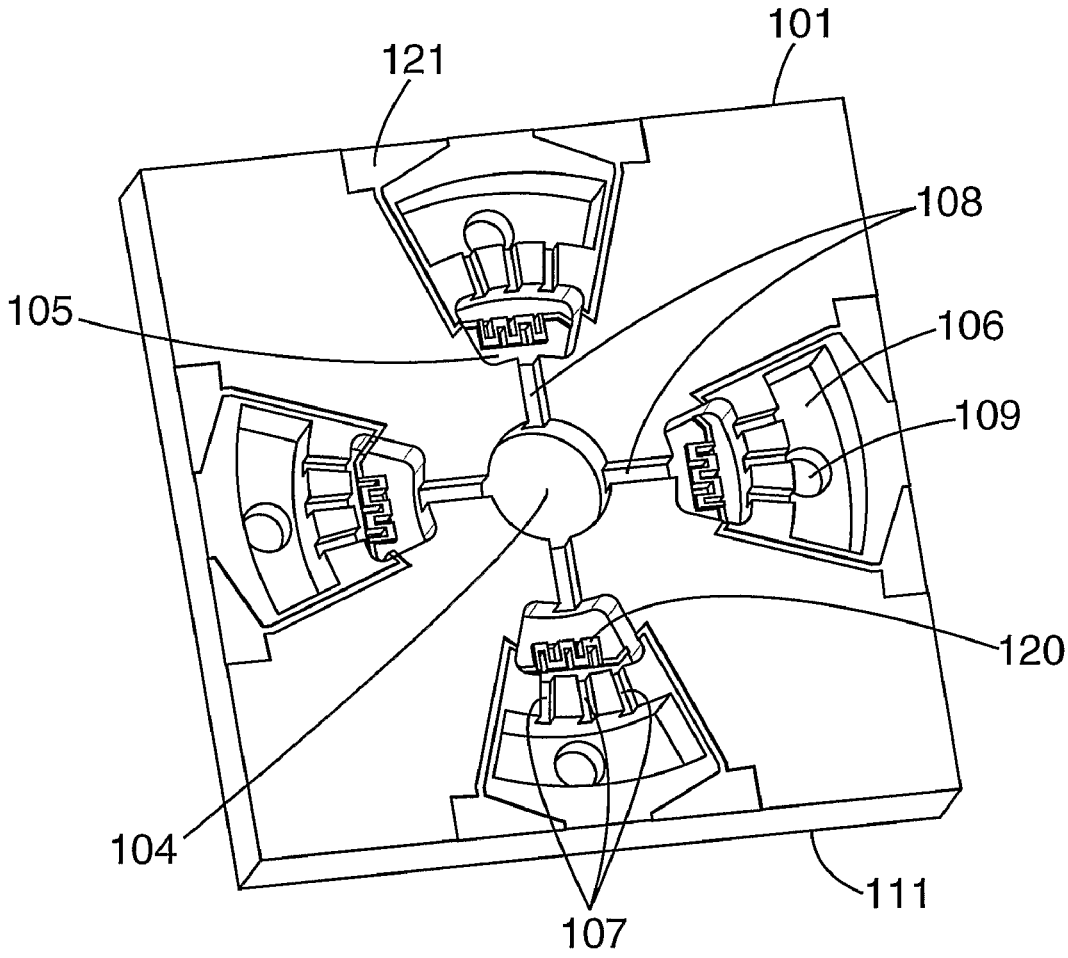
FIG. 3 is a view similar to FIG. 2 of a second embodiment of the ejection head.
Figure 4:
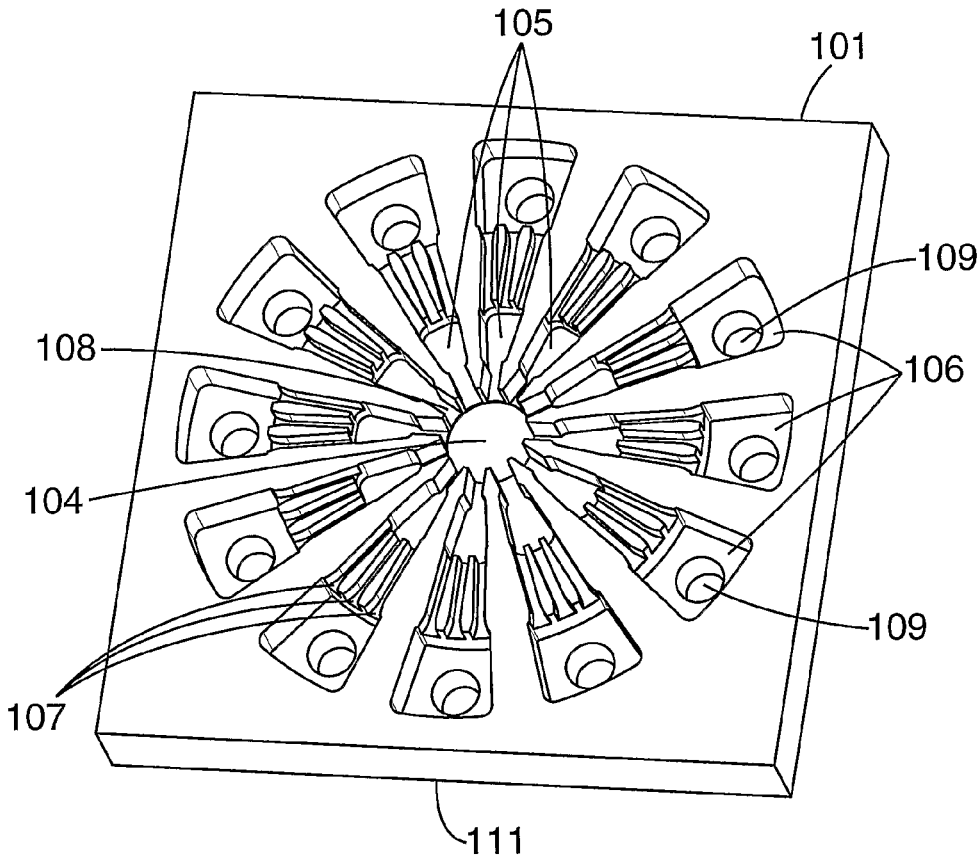
FIG. 4 is a view similar to FIG. 2 of a third embodiment of the ejection head.

For this first embodiment, six actuating chambers are provided, but other embodiments are also possible, such as the second and third embodiment illustrated in FIG. 3 and FIG. 4. FIG. 3 illustrates a base plate 101 with four sets of actuation modules surrounding a central exit chamber 104. FIG. 4 illustrates a base plate 101 with 12 sets of chambers. However, embodiments are not limited to these examples and could take any number of chambers 105.

The embodiments illustrated in FIG. 3 and FIG. 4 differ further in that these embodiments do not have a deflection member 103 positioned in the central ejection chamber 103. In these embodiments, instead of using a deflection member 103, the deflection will be effected by having actuation actuated in pairs in the exact same instant of time with the same amount of energy provided by the control unit 20, such that the droplets meet in the center of the exit chamber 104 and are self-deflected out through the singular nozzle 99. An even number of chambers 105 enable to obtain frontal collision in the central ejection chamber, and an exit through the nozzle 99.

Figure 5:
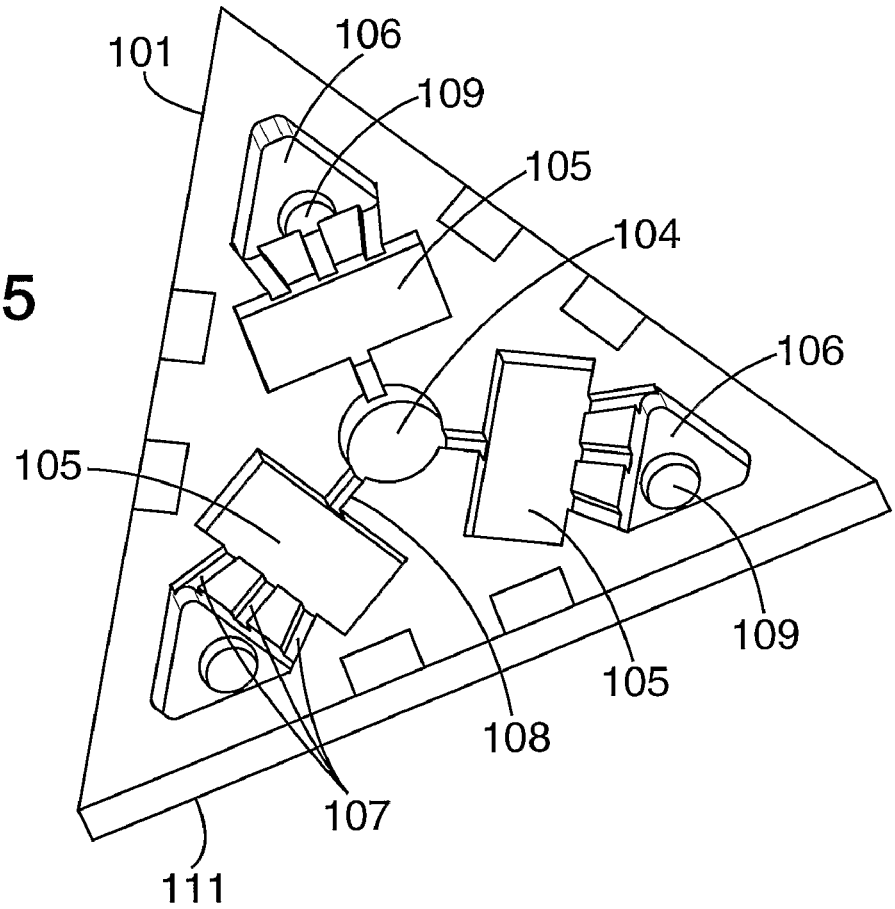
FIG. 5 is a view similar to FIG. 2 of a fourth embodiment of the ejection head.

In a fourth embodiment shown in FIG. 5 three actuators are provided. The same process may also be effected provided all three actuators 120 actuate at the same time with the same energy. The base plate 101 in this case is triangular shaped and each of the three sets of actuating chambers 105 and liquid feed chambers 106 are positioned and aligned towards the apex of the triangular shape, i.e. the feeding and actuating chambers 106,105 form modules at 120° apart from each other. These properties would also apply to any other embodiments having an odd number of chambers. In the case of three chambers 105, it has the advantage of having a 50% space and material saving, which for mass production can lead to significant cost savings, as well as time saving for manufacturing as less chambers would have to be created and less through-holes 109 machined in the liquid feed chamber 106.

Actuating chambers 105, and more particularly actuators 120, can be controlled individually, in groups, or all together in parallel. However, in practice the actuators 120 are operated in opposite pairs or groups, irrespective of the numbers of chambers present. In a typical configuration of such a droplet ejecting device 100 as described above, a microscopic droplet pulsed from the actuating chamber 105 typically has a volume in the range 25 to 80 pl, such that the total volume of all chambers is approximately 150-200 pl.

It is important to note that this concept could be implemented using any actuating means, including piezoelectric, thermal, or electrostatic actuators. The different means of actuation will just serve to pressurize or depressurize liquid 16 in an actuating chamber 120 in different ways in order to pulse the liquid into the central chamber 104 and then onto a support 2.

FIG. 6 is a detailed view of one liquid ejecting module. This particular embodiment illustrates a thermal ink ejection head 120. The electrical connection connecting the head to the control unit 20 is embedded in, but may be superimposed on, the base plate 101. For this embodiment, these connections 121 lead to the edge of the wafer 101 where it will be further connected to the control unit 20.

The most common means of actuating a liquid pulse is with a thermal head, however it suffers from the disadvantage of limited life. To go some way towards alleviating this problem of limited life, the control unit can be configured to rotate the usage of a specific actuator as a function of previous action to spread the wear evenly across all actuators.

Another actuating means is with piezoelectric actuators. These have the advantage of having no limitations when used together with non water-based liquids. However, they suffer in hand-held applications from the high-voltages needed for actuation.

The preferred means of actuation is with an electrostatic actuator due to its high energy efficiency, particularly at small scales. It is not limited also to water based liquids and only low voltages are needed.

A further embodiment possible under this invention is the ability of mixing different liquids, for example the ability of mixing different colored inks. Instead of having a liquid reservoir 15 containing a single color, one could conceivably separate the reservoir into different containers for different colors, but not necessarily in equal volumes, to take into account different weighing factors or usage rates. A plurality of feeding channels 130 could then be made into the support 110 of the liquid ejecting head such that only a subset of the total number of actuators is responsible for each color. With this embodiment, and using four separate colors comprising cyan, magenta, yellow and black, it is conceivable that the user could write in any color, from a combination of the above colors.

Next, a method of ejecting a liquid droplet from the liquid droplet ejecting heads 100 according to the embodiments will be described.

As mentioned above, the ejecting head 100 is mounted on the end of a writing instrument 1 for a particular embodiment, and the liquid instrument 1 comprising a control unit 20, an energy source 17 for powering the control unit 20, and a liquid reservoir 15.

The ink is stored in either a fixed or replaceable ink reservoir 15 in the body of the writing instrument 1, and feeds the droplet ejecting head 100 with ink 16 through at least one fluidic communicating channel 130. The liquid feed chamber 106 allows a small individual reserve of ink 16 to be available to its corresponding actuating chamber 105, and the perforated hole 109 provided in the feed chamber 106 communicates with the liquid reservoir 15.

The actuator 120 type in the actuating chamber 105 may comprise, but is not restricted to the following types: electrostatic, piezoelectric, thermal. This document will not enter into the detailed working of these different types of actuators as they exist in various embodiments, and they are well known in the art.

Once the control unit 20 determines it appropriate, the actuators 120 in the actuating chambers 105 actuates from a pulsed energy input provided by the control unit 20. This burst of energy will be mostly directed through the path of least resistance which is along a ray towards the central ejection chamber 104, passing notably through the provided channel 108. A pulse wave containing a small amount of liquid 16 from the actuating chamber 105 will move toward the nozzle 99. This liquid-carrying pulse wave from the actuating chamber 105 will traverse the base plate 101 along the main plane towards the nozzle 99.

If the embodiment contains a deflecting member 103, then the droplet is deflected on the member 103 and exits out of the nozzle 99 contained in the cover plate 102, and possibly at the same time amalgamating with other pulsed droplets effected at the same instant of time, from other actuating chambers 105.

If there is no central deflection member 103, then the pulse wave of liquid are ejected in opposite symmetrical pairs such that their lateral energy cancel out and only a longitudinal component of this exists to exit as a single drop out of the nozzle 99. Note that this arrangement is also conceivable with three or five actuators 120 positioned 120° or 72° apart.

Generally it will be preferable to have an even number of actuators 120 effected in opposite pairs, whether or not there is a deflection member 103 contained in the central ejection chamber 104 or not.

It may be desirable to spread the usage of the actuators 120 such that each actuator accumulates, on average, approximately the same number of actuation. This is especially desirable for the thermal-type actuators. The head 100, and also the control unit 20, must be capable of inking at a sufficiently high frequency such that individual drops of ink are not visible and the ejection appears continuous. The control unit 20 will therefore actuate a varying number of actuators 120 at a fixed frequency of between 500-800 Hz, such as to attain a reasonable drop size on the writing surface so as to attain a reasonable perceived thickness of the written line depending on the scan speed of the instrument 1. A total nozzle drop volume of approximately 150-200 pL is desirable in order to create a reasonable line width on the writing surface 2, for example 0.3 mm on a single pass.

An advantage of this over having a varying droplet size is that inking frequency can be maintained at a reasonable rate to prevent the individual drops from visibly separating, even if the pen tip moves quickly.

The control unit 20 will determine the number of actuators 120 to actuate to vary line widths as a function of pen scanning speed sourced from internal sensors such as accelerometers 22, or external commands such as pressure on the pen grip, or user settings.

The droplets size could be also determined according to the sensed distance between the nozzle 99 and the medium 2 to guarantee an impact of the droplets against the medium 2. It is also possible to vary the droplets size to vary the thickness of the written line.

The invention claimed is:

1. A liquid droplet ejecting head designed to be mounted in a liquid ejecting instrument, the head comprising:

at least one liquid supply chamber;

a control device;

an ejection nozzle;

a plurality of actuating chambers, each actuating chamber having:

at least one inlet to be connected to the at least one liquid supply chamber for providing liquid to the actuating chamber; and at least one actuating device for creating a pulse wave in liquid contained therein when activated by energy received from the control device, and at least one outlet connected to an ejection nozzle, wherein the outlets of the plurality of actuating chambers are linked to the ejection nozzle that defines a single common ejection nozzle through which a droplet is ejected from the head.

2. The liquid droplet ejecting head according to claim 1, wherein the outlets of the actuating chambers are connected to a common central exit chamber, the exit chamber being in connection with the ejection nozzle.

3. The liquid droplet ejecting head according to claim 2, wherein the central exit chamber contains a deflection member to deflect liquid flow pulses towards the ejection nozzle.

4. The liquid droplet ejecting head according to claim 1, wherein the plurality of actuating chambers are arranged around the common ejection nozzle in a radial pattern.

5. The liquid droplet ejecting head according to claim 4, wherein the actuating chambers are arranged in a symmetrical pattern and in an even number.

6. The liquid droplet ejecting head according to claim 4, wherein the head comprises a triangular-shaped flat body and the plurality of actuating chambers include three actuating chambers extending respectively toward the three edges of the triangular shaped flat body.

7. The liquid droplet ejecting head according to claim 1, further comprising a plurality of liquid feed chambers, each communicating with at least one actuating chamber and having or sharing a through hole in fluidic connection with a liquid reservoir.

8. The liquid droplet ejecting head according to claim 1, wherein said head is substantially flat shaped with a front face and a rear face, parallel to each other, the nozzle being formed in the front face, and holes in communication with the inlets of the actuating chambers being provided on the rear face.

9. The liquid droplet ejecting head according to claim 1, wherein the head includes a flat body having a main plane, and wherein the inlets and outlets of the plurality of actuating chambers extend globally in the main plane of the flat body, and along a radial direction from the ejection nozzle direction.

10. The liquid droplet ejecting head according to claim 1, wherein the liquid ejecting head is manufactured out of a silicon wafer.

11. The liquid droplet ejecting head according to claim 1, wherein the at least one actuating device comprises electrostatic, thermal or piezoelectric actuating means.

12. A hand held liquid ejecting instrument having a substantially tubular body with an opening at a front end and containing a liquid reservoir, an energy storage means, a control unit and a liquid droplet ejecting head according to claim 1, wherein the ejection nozzle of the ejection head faces out of the front opening of the tubular body.

13. A method of ejecting liquid droplets from a liquid ejecting head mounted in a liquid ejecting instrument comprising:

providing a plurality of actuating chambers, each actuating chamber having at least one inlet, at least one actuating device for creating a pulse wave in the liquid contained therein, and at least one outlet;

providing in the head a single ejection nozzle in fluidic connection with the outlets of the plurality of actuating chambers;

feeding the actuating chambers through their inlet with liquid provided from a liquid reservoir; and actuating at least one of the actuating devices by a supply of energy from a control unit in a manner such that one liquid droplet is ejected from the head through the ejection nozzle.

14. The method of ejecting liquid droplets from a liquid ejecting head according to claim 3, wherein the actuating step comprises the simultaneous actuation of at least two actuators.

15. The method of ejecting liquid droplets from a liquid ejecting head according to claim 13, wherein the actuating step comprises the actuation of an even number of the actuating devices, and wherein the actuating devices are arranged in opposite symmetrical pairs.

16. The method of ejecting liquid droplets from a liquid ejecting head according to claim 13, wherein the actuating step comprises the actuation of an odd number of devices, and wherein the actuators are arranged equidistant and in equiangular position with respect to the common ejection nozzle.

17. The method of ejecting liquid droplets from a liquid ejecting head according to claim 13, wherein the method further comprises a step of determining a number of actuating devices to be actuated to obtain a determined droplet size, before the actuating step.

18. The method of ejecting liquid droplets from a liquid ejecting head according to claim 13, wherein the instrument is a hand held instrument comprising sensing means that include at least one distance sensing means and movement sensing means, wherein the liquid is an ink, and wherein the method further comprises the steps of:

determining a writing condition from the signals sensed by the sensing means;

ejecting ink droplets repeatedly while a writing condition is determined, and at a constant ejection frequency.

19. The method of ejecting liquid droplets from a liquid ejecting head according to claim 18, further comprising the step of:

evaluating the droplet size according to at least one of the parameters of the group including a sensed scan speed of the writing instrument a sensed distance between a writing surface and the ejection nozzle, and desired thickness or style of the line to be drawn.

20. The liquid droplet ejecting head according to claim 1, wherein the outlets of the plurality of actuating chambers are guiding liquid radially towards the ejection axis defined by the ejection nozzle.

* * * * *